US008358209B2

(12) United States Patent
Shafer et al.

(10) Patent No.: US 8,358,209 B2
(45) Date of Patent: Jan. 22, 2013

(54) TECHNIQUES FOR DETECTING RFID TAGS IN ELECTRONIC ARTICLE SURVEILLANCE SYSTEMS USING FREQUENCY MIXING

(75) Inventors: Gary M. Shafer, Boca Raton, FL (US); Ming-Ren Lian, Boca Raton, FL (US); Richard L. Copeland, Lake Worth, FL (US)

(73) Assignee: Sensomatic Electronics, LLC, Boca Raton, FL (US)

( * ) Notice: Subject to any disclaimer, the term of this patent is extended or adjusted under 35 U.S.C. 154(b) by 1541 days.

(21) Appl. No.: 11/144,883

(22) Filed: Jun. 3, 2005

(65) Prior Publication Data

US 2006/0273902 A1 Dec. 7, 2006

(51) Int. Cl.
*G08B 13/14* (2006.01)

(52) U.S. Cl. ..... 340/572.1; 235/375

(58) Field of Classification Search .... 340/572.1–572.9; 235/375–385

See application file for complete search history.

(56) References Cited

U.S. PATENT DOCUMENTS 4,249,167 A 2/1981 Purinton et al.
4,646,090 A * 2/1987 Mawhinney ..... 342/44
5,349,332 A * 9/1994 Ferguson et al. ..... 340/572.2
5,714,937 A * 2/1998 Campana, Jr. ..... 340/573.1
6,356,197 B1 3/2002 Patterson et al.
6,486,769 B1 * 11/2002 McLean ..... 340/10.32
2005/0040950 A1 2/2005 Clucas

FOREIGN PATENT DOCUMENTS

WO WO 00/42584 A 7/2000

OTHER PUBLICATIONS

PCT International Search Report dated Oct. 12, 2006 (Appln. No. PCT/US2006/021494) International Searching Authority: European Patent Office.

* cited by examiner

*Primary Examiner* — George Bugg
*Assistant Examiner* — Edny Labbees
(74) *Attorney, Agent, or Firm* — Kacvinsky Daisak PLLC

(57) ABSTRACT

Disclosed are a system and method to detect RFID tags in electronic article surveillance systems using frequency mixing. The system includes an RFID module that includes an energy coupler to receive transmitted energy that includes a first signal at a first frequency and a second signal at a second frequency, and a mixing element to mix the first and second signals, to generate a third signal at a third frequency, and the energy coupler to transmit the third signal to an EAS detection system. Other embodiments are described and claimed.

21 Claims, 7 Drawing Sheets

800

900

TECHNIQUES FOR DETECTING RFID TAGS IN ELECTRONIC ARTICLE SURVEILLANCE SYSTEMS USING FREQUENCY MIXING

BACKGROUND

Electronic article surveillance (EAS) systems are used to control inventory and to prevent or deter theft or unauthorized removal of articles from a controlled area. The system establishes an electromagnetic field or "interrogation zone" that defines a surveillance zone (typically entrances and/or exits in retail stores) encompassing the controlled area. The articles to be protected are tagged with an EAS security tag. Tags are designed to interact with the field in the interrogation zone. The presence of a tag in the interrogation zone is detected by system receivers and appropriate action is taken. In most cases, the appropriate action includes the activation of an alarm.

EAS security tags may be affixed to any article, such as, for example, an article of merchandise, product, case, pallet, container, and the like, to be protected, monitored, retained, sold, inventoried, or otherwise controlled or distributed in some manner. The tag includes a sensor element adapted to interact with the electromagnetic field in the interrogation zone. In operation, an EAS system transmitter interrogates the tag by radiating a first signal at the tag's tuned resonant frequency. Some tags also respond to a second radiated field that is outside of the tag's tuned resonant frequency. The interaction of the first and/or second fields with the sensor element causes a change in the tag's characteristics that establishes the presence of an additional detection signal in the interrogation zone. The generation of harmonic frequencies, the generation of mixing side bands, or the re-radiation of the first signal modulated by the second signal, among other effects. Accordingly, if an article tagged with an EAS security tag traverses the interrogation zone, the EAS system recognizes the detection signal as an unauthorized presence of the article in the controlled area and may activate an alarm under certain circumstances, for example.

Radio frequency identification (RFID) utilizes interrogation and reply frequencies in the radio frequency (RF) band to perform electronic article identification (EAI) functions. An RFID tag is attached to an article to be identified. The RFID tag responds to an RF interrogation signal and provides the identification information in the form of an RF response signal. The identification information may comprise article identification information, pricing information, inventory control, and can receive and store information such as the date and place of sale, sales price, and article manufacturing authenticity information, for example. RFID tags comprise an integrated circuit (IC) and an antenna connected thereto. The IC may comprise a variety of architectures and the item identification code may be stored in a variety of code formats.

A transceiver and an RFID tag form an RFID system and communicate with each other over a wireless RF communication channel. The transceiver may comprise a hardware device to interrogate the RFID tag and initiate reading the article identification code. The transceiver may comprise an RFID transceiver adapted to communicate (e.g., read and write) information with the RFID tag. In operation, the transceiver sends a request for identification information to the RFID tag over the wireless RF communication channel and the RFID tag responds accordingly.

Conventional RFID tags, however, are typically not well suited to EAS applications because of its limited detection range due to the threshold effects. Presently, to obtain EAS and electronic article interrogation (EAI) functionality, EAS tags and RFID tags both are usually attached to an article if identification and protection of the article are desired. In some applications, RFID and EAS functions may be integrated within the same tag housing. The RFID and EAS functions, however, are usually electrically separate, discrete functions that are co-located within one enclosure.

It is sometimes desirable to have the EAS and RFID functionality present in the same tag housing. In some implementations, an RFID IC may include EAS as an auxiliary function. The combined EAS and RFID functions may be accomplished by physically packaging separate RFID and EAS tags together in a single housing. In some implementations, an RFID tag may be modified to simulate an EAS function by sending special codes when a reader interrogates the RFID tag. Physically packaging two separate RFID and EAS tags in a single housing, however, may be expensive because it may require two separate devices, a large bulky package, and the interaction between the two tags may degrade the detection range of both the RFID and the EAS functions. Using the RFID function with special codes to simulate the EAS function also is inferior. Typically an RFID IC requires a turn-on voltage of 1.3 volts or greater in order to operate. This turn-on voltage threshold requirement may limit the overall detection range if the interrogation signal received by the RFID is not sufficient to overcome the turn-on voltage threshold in order to provide an adequate amount of power to the IC.

SUMMARY OF THE INVENTION

Embodiments of the invention may include a system comprising an RFID module having an energy coupler to receive transmitted energy comprising a first signal at a first frequency and a second signal at a second frequency, and a mixing element to mix the first and second signals, to generate a third signal at a third frequency, and the energy coupler to transmit the third signal to an EAS detection system.

The invention may also be embodied in a method comprising the steps of receiving a first and second signal at a first and second frequency at an RFID module; mixing the first and second signals at the RFID module; generating a third signal at a third frequency; and transmitting the third signal to an EAS detection system.

BRIEF DESCRIPTION OF THE DRAWINGS

For a better understanding of various embodiments of the invention, reference should be made to the following detailed description which should be read in conjunction with the following figures wherein like numerals represent like parts.

DETAILED DESCRIPTION

Figure 1:
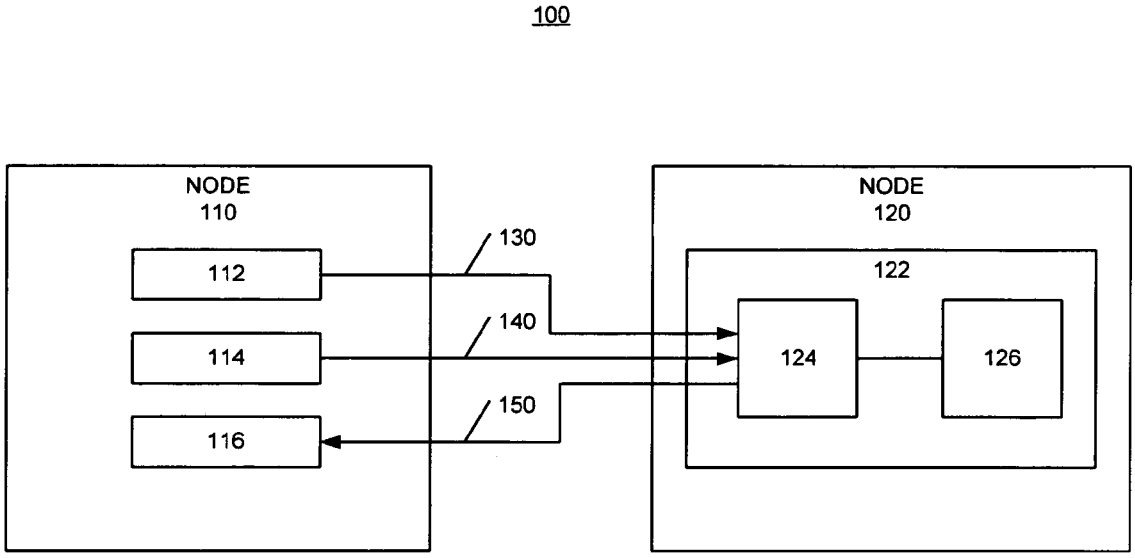
FIG. 1 illustrates a block diagram of a system in accordance with one embodiment.

For simplicity and ease of explanation, the invention will be described herein in connection with various exemplary embodiments thereof. Those skilled in the art will recognize, however, that the features and advantages of the invention may be implemented in a variety of configurations. It is to be understood, therefore, that the embodiments described herein are presented by way of illustration, not of limitation.

FIG. 11 illustrates a block diagram of a system 100. System 100 may comprise, for example, a surveillance and identification system having multiple nodes 110, 120, among others, for example. A node may comprise any physical or logical entity capable of receiving information from a node, transmitting information to a node, or a combination of receiving and transmitting information between any nodes. Examples of a node may comprise any device having communication capabilities. In one embodiment, a node may comprise any device having wireless communication capabilities. In one embodiment, a node may comprise a wireless communication module, a checkout device, scanner, transceiver, RFID transceiver, deactivator, detector, articles of merchandise comprising an identification code, RFID module, RFID tag, and/or EAS tag, among others. The embodiments are not limited in this context.

In one embodiment, system 100 may comprise elements of a combined electronic article surveillance (e.g., EAS) and electronic article identification (e.g., EAI) system such as a combined RFID and EAS system, for example. In one embodiment, system 100 may be installed on the premises of a retail store, for example. Accordingly, modules, devices or equipment associated with system 100 may be located at the exit or entrance of a controlled area defined in the retail store, for example, to monitor the presence of tagged articles in the interrogation zone. The embodiments are not limited in this context.

System 100 nodes 110, 120 may be arranged to communicate different types of information associated with articles, including for example, information contained in RFID and EAS tags. Information may be transmitted by way of radiated energy in the form of magnetic, electric or electromagnetic fields emanating from a radiated energy source. The information may be transmitted in the form of radiated signals. The radiated signals may be modulated with any required information or may interact with other radiated signals to generate additional radiated signals that can be detected by suitable devices at any one node 110, 120, for example. In one embodiment, two or more radiated signals may be mixed by suitable mixing elements located in any one node 110, 120, for example. The embodiments are not limited in this context.

The information may be contained within an article or a tag affixed to the article. Information may refer in a very general sense to any signal or data representing content, such as information associated with articles, such as RFID tags, EAS tags. Information may be in the form of bar codes, voice, video, audio, text, numeric, alphanumeric, alphanumeric symbols, graphics, images, symbols, and so forth. The information also may include control information, which may refer to in a very general sense to any data representing commands, instructions or control words meant for system 100. For example, control information may be used to interrogate RFID and EAS tags, route the information through system 100, or instruct a node 110, 120 to process the information in a certain manner. The embodiments are not limited in this context.

System 100 nodes may communicate such information in accordance with one or more techniques. These techniques may comprise utilization of a set of predefined rules or instructions to control how nodes 110, 120 communicate information between each other. These techniques may be defined by one or more standards as promulgated by a standards organization, and so forth. These techniques may be proprietary and defined by proprietary rules. The embodiments are not limited in this context.

Embodiments of system 100 may comprise a wired or wireless surveillance and identification system or a combination thereof. Although system 100 may be illustrated using a particular communications media by way of example, it may be appreciated that the principles and techniques discussed herein may be implemented using any type of communication media and accompanying technology. The embodiments are not limited in this context.

When implemented as a wireless surveillance and identification system, for example, embodiments of system 100 may include one or more wireless nodes 110, 120 comprising radiated energy sources arranged to communicate information over one or more types of wireless communication media. Wireless communication media may comprise portions or any combinations of the electromagnetic spectrum comprising all forms of electromagnetic radiation. For example, wireless communication media may comprise electromagnetic fields, electric fields, magnetic fields, and combinations thereof, propagating through space from direct current (DC) to gamma rays. Signal frequencies may be embodied in any electromagnetic, electric, or magnetic fields, and combinations thereof. Wireless nodes 110, 120 may include components and interfaces suitable for communicating radiated information signals over the designated wireless spectrum, such as one or more antennas, wireless transmitters/receivers ("transceivers"), amplifiers, filters, control logic, and so forth. As used herein, the term "transceiver" may include, in a very general sense, a transmitter, a receiver, or a combination of both. Examples of an antenna may include an internal antenna, an oni-directional antenna, a monopole antenna, a dipole antenna, an end fed antenna, a circularly polarized antenna, a micro-strip antenna, a diversity antenna, a dual antenna, an antenna array, a helical antenna, a flexible substrate with a metallic antenna pattern formed thereon, an antenna pattern fabricated through die-cut, chemical etching, physical/chemical deposition process, printing process, and so forth. The embodiments are not limited in this context.

In one embodiment, node 110 may comprise the necessary electrical/electronic hardware and software components to establish an interrogation process in the surveillance zone encompassing the controlled area. Node 120 may establish the interrogation zone such that tags present in the interrogation zone are detected. In one embodiment, system 100 may include one or more communication media to communicate information between nodes 110 and 120. For example, communication media may comprise wireless communication media as desired for a given implementation.

In one embodiment, node 110 may comprise radiated energy sources and devices suitable to generate and transmit one or more signals at one or more frequencies. Node 110 also may comprise devices suitable to receive one or more signals at one or more frequencies to detect the presence of a tag and/or to read information from a tag. In one embodiment, node 110 comprises a module 112 suitable to generate and transmit a first signal 130. In one embodiment, node 110 also may comprise a module 114 suitable to generate and transmit a second signal 140. In one embodiment, node 110 may comprise a module 116 suitable to receive a third signal 150, for example. In one embodiment, fields (e.g., magnetic, electric, or electromagnetic) associated with the first and second signals 130, 140 overlap each other in the controlled area.

In one embodiment, modules 112, 114, and 116 form a security tag detection system, such as, for example, an EAS system. In one embodiment, modules 112, 114, 116 may comprise a magneto-mechanical EAS system. For example, modules 112, 114, 116 may include one or more antenna pedestals, receiver/detection electronics, and an alarm, for example. Modules 112, 114, 116 also may include one or more wireless transmitters and receivers to establish the surveillance zone at entrances and/or exits in retail stores, for example, encompassing the controlled area, for example.

Module 114 may be arranged to generate and radiate energy. In one embodiment, module 114 may generate a magnetic field, electric field, or electromagnetic field to interact with the fields generated by module 112, for example. In one embodiment, detection node 110 also may comprise one or more RFID transceivers to communicate with combination RFID/EAS tags at node 120, for example.

Node 120 may comprise a wireless module 122 (e.g., a tag). Wireless module 122 may comprise an energy coupler 124 and a controller 126, for example. The energy coupler 124 receives and transmits radiated energy. Examples of energy coupler 124 comprise an antenna, coil, resonant inductor/capacitor (LC) circuit, dipole antenna, matching circuit, and the like. In one embodiment, energy coupler 124 also provides the necessary power to operate wireless module 122 in RFID mode, for example, including the operation of controller 126. Controller 126 controls the operation of wireless module 122 including the operation of energy coupler 124. In one embodiment, energy coupler 124 receives and couples radiated energy comprising first and second signals 130, 140. The information contained in first and second signals 130, 140 may be demodulated and coupled into controller 126 for data recovery, processing, storage, and power. Radiated energy comprising first and second signals 130, 140 may be mixed by elements forming portions of the electronic circuitry of wireless module 122 to produce third signal 150. Third signal 150 may be re-radiated to node 110 or other node, through energy coupler 124, for example. In one embodiment, wireless module 122 may comprise a mixing module suitable for mixing first and second signals 130, 140 and generating third signal 150.

In order to operate wireless module 122 as a conventional RFID device, enough energy should be coupled by energy coupler 124 from first and second signals 130, 140 to overcome the turn-on voltage threshold of controller 126. In one embodiment, however, wireless module 122 may function as an EAS tag even if less than the turn-on voltage threshold is coupled by energy coupler 124. Accordingly, wireless module 122 is adapted to produce mixing products of first second signals 130, 140 suitable for EAS functionality whether or not enough energy is coupled by energy coupler 124 to supply a suitable amount of power to turn-on and operate controller 126. Thus, wireless module 122 may function as an EAS tag even though it is essentially inoperative as a conventional RFID device. Accordingly, in EAS detection mode, wireless module 122 has a much greater detection range than a conventional RFID device operating in EAS mode because it does not have to overcome the turn-on threshold. Wireless module 122 will couple first and second signals 130, 140 and re-radiate third signal 150 comprising the mixing products whether or not there is sufficient energy present in first and second signals 130, 140 to overcome internal thresholds and provide a suitable amount of energy to turn-on controller 126.

In one embodiment, wireless communication module 122 may comprise identification and security tags. In one embodiment, identification and security tags may comprise RFID identification functions and/or EAS security, or a combination thereof, for example. In one embodiment, wireless communication module 122 may comprise, for example, dual RFID/EAS functionality provided within a single housing or a single IC, for example. In one embodiment, wireless communication module 122 may comprise RFID/EAS functionality using a single RFID tag designed for RFID identification applications only. In one embodiment, the RFID tag may be modified to include the EAS functionality.

Although communication between specific nodes 110, 120 is described, communications may take place between nodes 110, 120 and any other device in node system 100, for example. In one embodiment, for example, wireless communication module 122 may transmit surveillance and identification information to node 110 on a real time basis, for example. In one embodiment, either node 110 or 120 may comprise identification information transceiver functionality integrated therewith as well as security tag detection electronics integrated therewith.

Embodiments of node 110 may be located at the exits of the controlled area, for example. Nodes 110 and 120, either alone or in combination, may be arranged to detect active RFID/EAS tags located in proximity of node 110. For example, if a person attempts to exit the premises of a store with an article comprising an active RFID/EAS tag, node 110 interrogates the signatures associated with RFID/EAS security tag. Should the article still contain an active or live RFID/EAS tag, node 110 will activate an alarm to prevent the unauthorized removal of the article from the premises. At that time, the person carrying the item may be asked to present the purchase transaction receipt for the tagged article. In another example, a person may attempt to enter the premises with unauthorized articles or with articles not purchased at that location for return. Accordingly, assistance may be rendered to the person to deactivate the alarming tag should this be an appropriate action.

Nodes 110 and 120 of system 100 each may comprise multiple elements. These elements may comprise, for example, a processor. The processor may be implemented as a general purpose processor, such as a general purpose processor. In another example, the processor may include a dedicated processor, such as a controller, microcontroller, embedded processor, a digital signal processor (DSP), a field programmable gate array (FPGA), a programmable logic device (PLD), a network processor, an I/O processor, an Application Specific Integrated Circuit (ASIC), and so forth. The embodiments are not limited in this context.

Figure 2:
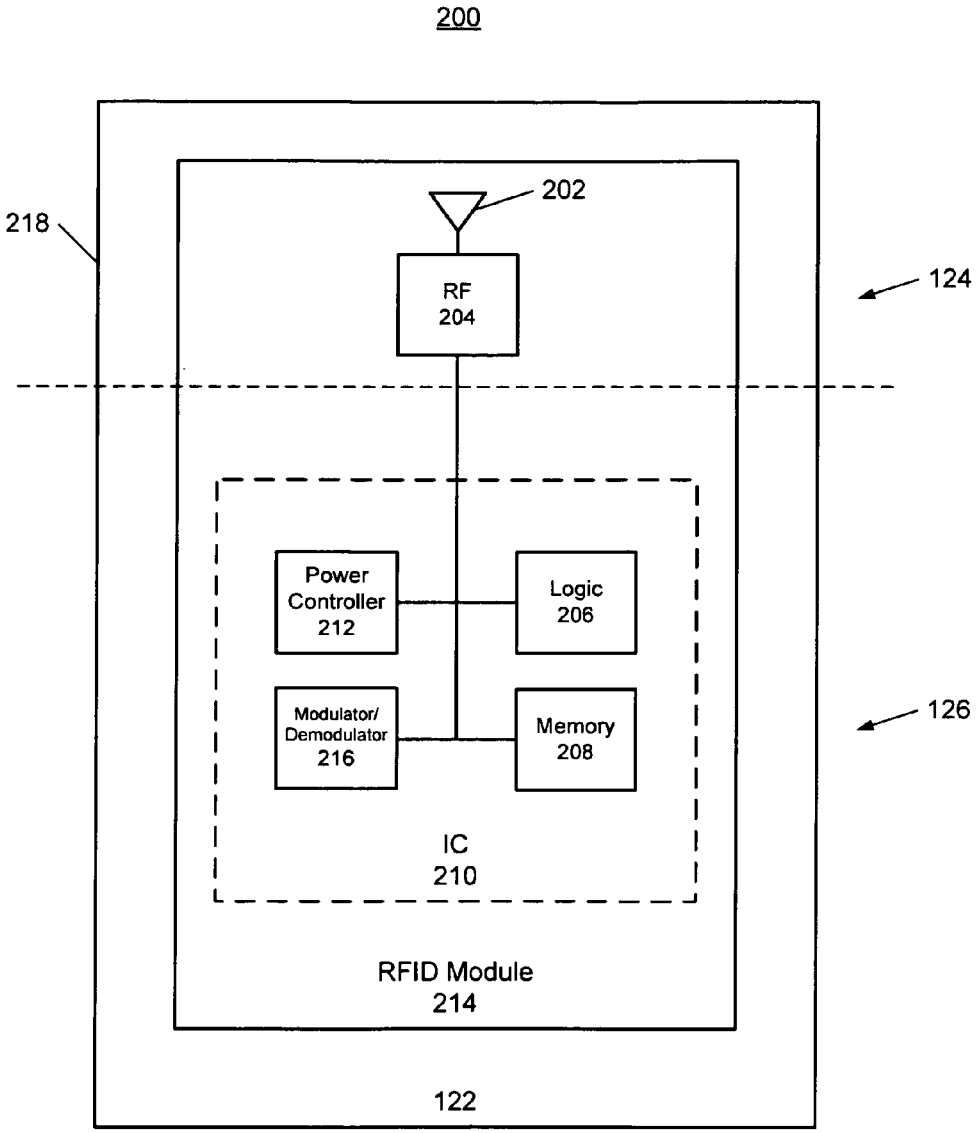
FIG. 2 illustrates a block diagram of a wireless communication module in accordance with one embodiment.

FIG. 2 illustrates a block diagram 200 of one embodiment of wireless communication module 122 comprising combined RFID/EAS functionality in a single RFID module 214. As shown in FIG. 2, RFID module 214 comprises multiple elements some of which may be implemented using, for example, one or more circuits, components, registers, processors, software subroutines, or any combination, thereof. Although FIG. 2 shows a limited number of elements, it can be appreciated that RFID module 214 may comprise additional or fewer elements as may be desired for a given implementation. The embodiments are not limited in this context.

In one embodiment, RFID module 214 comprises energy coupler 124 and controller 126, for example. In one embodiment, energy coupler 124 may comprise antenna 202 to receive and transmit radiated energy from node 120, for example. In one embodiment, energy coupler 124 may comprise RF circuit 204 comprising, for example, a reactive circuit to couple radiated interrogating RF signals such as first signal 130. In one embodiment, the reactive circuit may comprise an LC circuit comprising an inductor and a capacitor, for example. In one embodiment, the reactive circuit may comprise a resonator, for example.

In one embodiment, RFID module 214 may comprise one or more EAS functional elements such as mixing elements, for example. These mixing elements may comprise one or more non-linear elements, non-linear electronic devices, modulation impedances, tuning capacitors, varactors, metal oxide semiconductor (MOS) capacitors, complementary MOS (CMOS) capacitors, varactor diode capacitors, AC/DC converters, rectifiers, diodes, transistors (bipolar junction transistors (BJT), field effect transistors (FET), etc.), magnetic elements, non-linear resonators, and other non-linear elements, for example.

In one embodiment, controller 126 may comprise semiconductor IC 210 coupled to RF circuit 204 and antenna 202. IC 210 may comprise logic 206, memory 208, power controller 212, and/or modulator/demodulator 216, for example. In one embodiment, the mixing elements may be formed integrally with IC 210, for example. In one embodiment, the mixing elements may be realized with discrete semiconductor elements or components or may be integrated in IC 210. In one embodiment, IC 210 may or may not include RF circuit 204. Often, RF circuit 204 may comprise, for example, a collection of discrete components such as, capacitors, transistors, and diodes that may be located off the IC 210. RF circuit 204 may be coupled to logic 206 and memory 208. In one embodiment, the mixing elements may be integrated with IC 210, for example. Logic 206 may comprise, for example, a processor, controller, state machine, programmable logic array, and the like, and may operate under the control of program instructions. Memory 208 may comprise, for example, program memory, data memory or any combination thereof. Memory 208 also may comprise, for example, random access memory (RAM), read only memory (ROM), programmable read only memory (PROM), erasable programmable read only memory (EPROM), electrically erasable programmable read only memory (EEPROM), combinations thereof, and the like. In one embodiment, memory 208 may be re-writable. Power control module 212 may contain the necessary elements to provide power to RFID module 214 using energy extracted from first and second signals 130, 140, for example. Modulator/demodulator 216 demodulates incoming signals 130, 140 and extracts the necessary data for processing and storage and modulates outgoing signals 150.

Active RFID modules may comprise a battery (not shown). Passive RFID modules 214, however, generally do not include a battery. Rather, passive RFID module 214 derives its energy from the radiated interrogating first signal 130 or second signal 140. The process may be controlled by power controller 212. For example, RFID module 214 may derive and store energy (e.g., comprising voltage or current components) from a reactive circuit that is responsive to an RF interrogation signal used to trigger a response from RFID module 214 (e.g., an interrogation signal transmitted by an EAS system or an RFID transceiver). Such a circuit may comprise, for example, an inductive coil, rectifying circuitry, a storage capacitor, and related circuitry permitting the RFID module 214 to respond to an interrogation signal such as first radiated signal 130 while present in the electromagnetic field of the interrogation signal, for example. During this period, a storage capacitor may be used to store sufficient voltage to power a desired operation of RFID module 214, for example.

In general, RFID module 214 may provide RFID and EAS functionality in a single housing 218 or a single IC, which may be formed as a single tag, for example. In one embodiment RFID module 214 may provide EAS functionality in a RFID module intended for RFID applications without modifying any elements of the RFID module circuitry. As previously discussed, RFID module 214 may provide EAS tag functionality even when first and second signals 130, 140 are too weak to supply enough energy to turn-on IC 210 and enable RFID module 214 to operate as a conventional RFID tag, for example.

Figure 3:
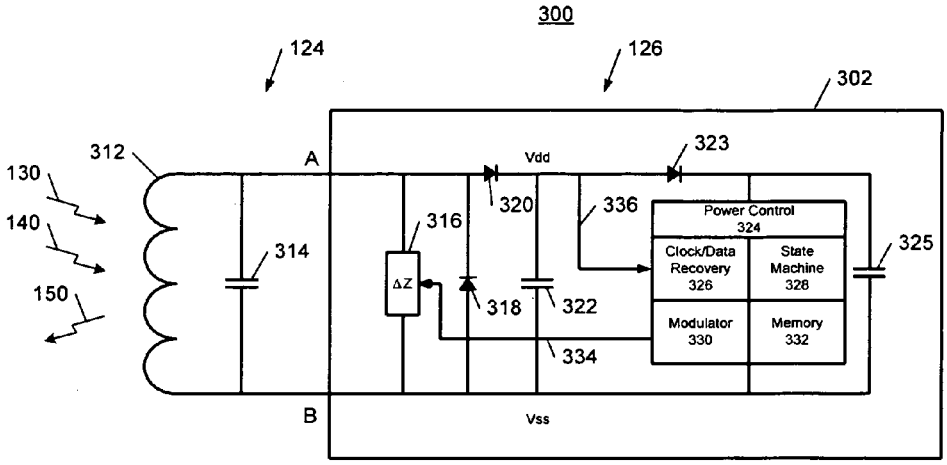
FIG. 3 illustrates a schematic diagram of a module in accordance with one embodiment.

FIG. 3 is a schematic diagram of a module 300, which may represent one embodiment of wireless communication module 122 comprising combined RFID/EAS functionality of RFID module 214. In one embodiment module 300 comprises a near field antenna suitable for coupling a magnetic field, for example. Module 300 comprises embodiments of energy coupler 124 and controller 126. In one embodiment, controller 126 may be embodied in circuit 302, which in one embodiment may be a single IC, for example. First and second signals 130, 140 received by energy coupler 124 are transferred to circuit 302 via terminals A and B and are mixed by elements of circuit 302 to produce third signal 150 comprising corresponding mixed frequency products. Module 300 may function as an RFID tag or an EAS tag if circuit 302 is turned on by power supply voltage $V_{DD}$ and may function as an EAS tag irrespective of power supply voltage $V_{DD}$ to circuit 302.

In one embodiment, energy coupler 124 may comprise an antenna coil 312 and a resonating capacitor 314 connected in parallel to form an LC circuit, for example. First and second signals 130, 140 are coupled by energy coupler 124 and are provided to circuit 302 via terminals A and B, for example. The LC circuit couples radiated energy comprising first and second signals 130, 140 and transmits third signal 150.

In one embodiment, circuit 302 may comprise modulation impedance 316 in parallel with energy coupler 124, for example. In one embodiment, circuit 302 may comprise a rectifier comprising rectifier diodes 318 and 320 across modulating impedance 316. Rectifier diodes 318, 320 detect the envelope, rectify, and dermodulate first and second signals 130, 140 received by antenna coil 312. Capacitor 322 is connected in parallel across diode 320. The voltage across capacitor 322 follows the detected envelope of the first and second signal 130, 140 waveforms. Power is routed via diode 323 and data is provided through connection 336. In one embodiment, various mixing elements of integrated circuit 302 mix the frequencies of first and second signals 130, 140 and generate third signal 150, for example. The mixed frequency products of third signal 150 are re-radiated by antenna coil 312. The mixed frequency products are suitable for activating an EAS detection system, for example.

In one embodiment, integrated circuit 302 may comprise functional logic blocks, for example, power controller 324, clock and data recovery logic 326, state machine 328, modulator 330, and memory 332, for example. A portion of the detected waveform is fed through diode 323 to power control module 324 and to charge capacitor 325. Power controller 324 regulates and conditions the power supply voltage to operate circuit 302. Demodulated first and second signals 130, 140 are fed to clock/data recovery circuit 326 via connection 336. Modulating signals may be fed from modulator 330 to modulating impedance 316 via connection 334, for example. In RFID mode the modulated signals are transmitted by antenna coil 312. Clock/data recovery logic 326 recovers data from the demodulated signals. In one embodiment, the data may be extracted from first signal 130. In one embodiment, the information may be extracted from second signal 140. In one embodiment, the information may be extracted from a combination of first and second signals 130, 140. Clock/data recovery logic 326 also provides the clock frequency to operate circuit 302. State machine 328 processes the data extracted by clock/data recovery logic 326. The resulting extracted and/or processed data may be stored in memory 332, for example.

In operation, module 300 may function as an RFID tag, an EAS tag or both. To function as an RFID tag, sufficient energy should be extracted from input signals 130, 140 to supply power to circuit 302. In powered mode, the interrogation field of first signal 130 at a first frequency is coupled into module 300. The received field of first signal 130 powers circuit 302 and simultaneously provides a data communication link between module 300 (e.g., node 120) and node 110, for example. Second signal 140 at a second frequency may be coupled into module 300. Second signal 140 frequency may be different from the first signal 130 frequency. Second signal 140 is provided to circuit 302 along with first signal 130. In powered mode, module 300 also may function as an EAS tag by transmitting third signal 150. In one embodiment, first and second signal 130, 140 frequencies are mixed and the resulting mixed frequency products are radiated from antenna coil 312 as third signal 150.

To function as an EAS tag, however, no power supply is required to operate circuit 302. In the unpowered mode, mixing elements in circuit 302 are capable of mixing first and second signals 130, 140, generating mixed frequency products, and re-radiating third signal 150 comprising the mixed frequency products to an EAS detection system. Mixing elements of module 300 provide the necessary mixing function to mix first and second signals 130, 140 frequencies. As previously stated, any non-linear element in module 300 may cause frequency mixing. For example, module 300 may comprise at least three non-linear elements capable of mixing frequencies. A first non-linear mixing element is modulation impedance 316. A second non-linear mixing element is either rectifier diode 318 or 320. A third non-linear mixing element is on-chip tuning capacitor 322, for example, a CMOS capacitor or a varactor diode capacitor. Any one of these non-linear elements either alone or in combination may be used to mix the frequencies of first and second signals 130, 140 to generate the mixing product forming third signal 150.

Figure 4:
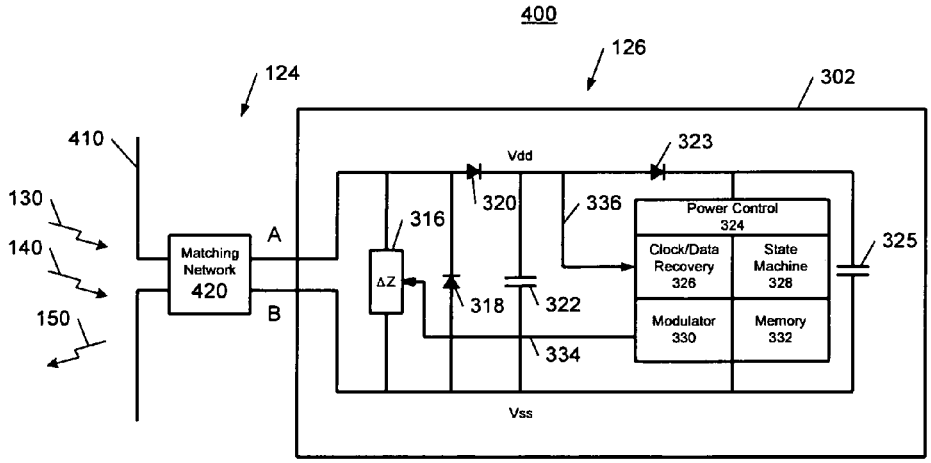
FIG. 4 illustrates a schematic diagram of a module in accordance with one embodiment.

FIG. 4 is a schematic diagram of a module 400, which may represent one embodiment of wireless communication module 122 comprising combined RFID/EAS functionality of RFID module 214. Module 400 comprises embodiments of energy coupler 124 and controller 126. Module 400 couples radiated energy comprising first and second signals 130, 140 and transmits third signal 150, for example.

In one embodiment, energy coupler 124 may comprise a far field antenna, such as for example, dipole antenna 410, coupled to a matching network 420. Dipole antenna 410 may be suitable to couple electric fields or magnetic fields. First and second signals 130, 140 are coupled by energy coupler 124 and are provided to circuit 302 via input terminals A and B, for example. Accordingly, in one embodiment, interrogation field of first signal 130 and a second mixing frequency such as second signal 140 may be coupled into module 400 via electric fields. The operation of circuit 302 is similar in structure and function as previously discussed with reference to FIG. 3.

Figure 5:
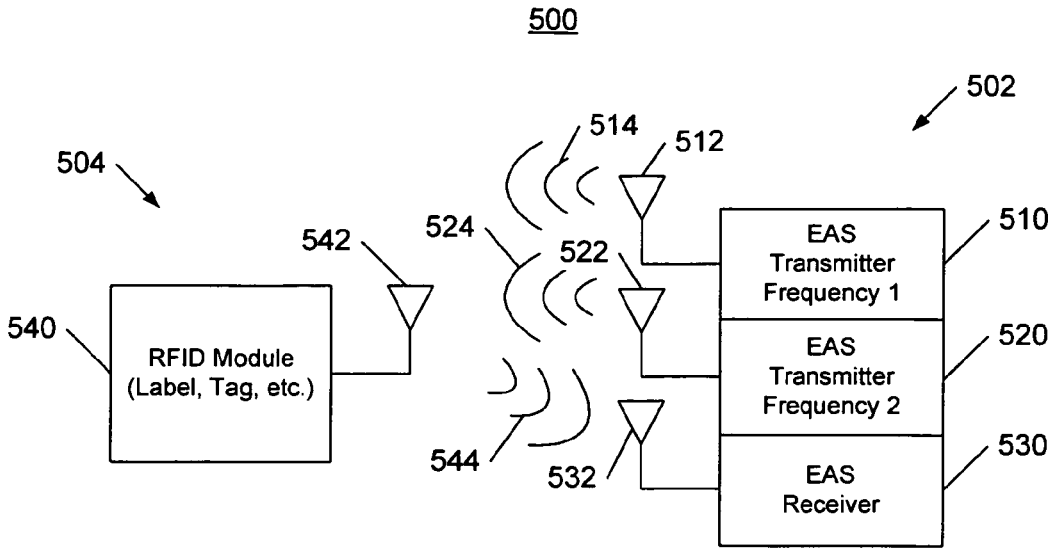
FIG. 5 illustrates a system in accordance with one embodiment.

FIG. 5 is one embodiment of system 100 comprising nodes 110, 120, which is illustrated as system 500. In one embodiment, system 500 may comprise one embodiment of node 110, illustrated as system 502, and may comprise one embodiment of node 120, illustrated as device 504. One embodiment of system 502 comprises first EAS transmitter 510, second EAS transmitter 520, and EAS receiver 530, for example. System 502 may be located wherever EAS functionality may be desired. System 502 transmits first and second signals 514, 524 at two or more frequencies with first and second transmitters 510, 520, respectively, for example. In one embodiment, the fields (e.g., magnetic, electric, or electromagnetic) of first and second signals 514, 524 overlap each other in the controlled coverage area. EAS receiver 530 detects the mixing products of the two frequencies of first and second signals 514, 524. In one embodiment, the EAS functionality may be achieved using RFID tags without any modifications to the RFID chip and, in one embodiment, without modification to the tag itself. This provides a combination of EAS and RFID functions in a single RFID tag located in a single housing without increasing the cost and size of the tag and without decreasing RFID performance. An RFID reader (not shown) may be located wherever RFID functionality may be desired. There, an RFID reader would read the RFID tag/label in a conventional manner.

In one embodiment, first EAS transmitter 510 transmits a first signal 514 via antenna 512, for example. In one embodiment, first signal 514 is transmitted at a first frequency. In one embodiment, first signal 514 may be an interrogation signal to interrogate RFID module 540, for example. RFID module 540 may be one embodiment of wireless communication module 122 comprising combined RFID/EAS functionality of RFID module 214. In one embodiment, second EAS transmitter 520 transmits a second signal 524 via antenna 522, for example. In one embodiment, second signal 524 is transmitted at a second frequency, which may be different from the first frequency of first signal 514. In one embodiment, second signal 524 may be a mixing signal to mix with the interrogation signal in RFID module 540, for example. In one embodiment, EAS receiver 530 receives a third signal 544 via antenna 532, for example. In one embodiment, third signal 544 is transmitted at a third frequency, which may be different from the first and second frequencies of first and second signals 514, 524. In one embodiment, third signal 544 may comprise the mixing products of first and second signals 514, 524 generated by RFID module 540, for example. One embodiment of device 504 comprises RFID module 540, for example. RFID module 540 may be one embodiment of wireless communication module 122, which comprises combined RFID/EAS functionality of RFID module 214. In one embodiment, RFID module 540 comprises antenna 542 to receive first and second signals 514, 524 and transmit third signal 544, which may comprise the mixing products of first and second signals 514, 524, for example, in response to the interrogation signal.

Figure 6:
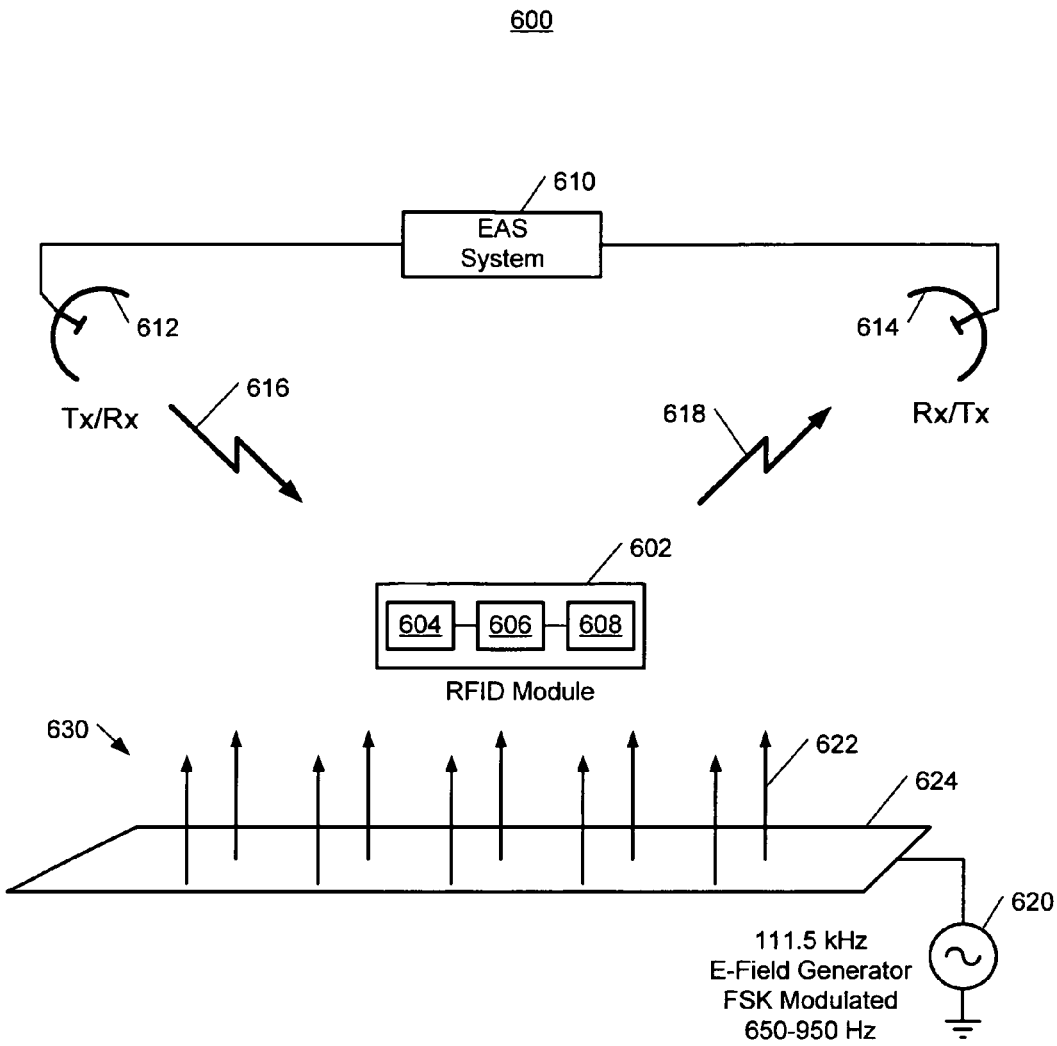
FIG. 6 illustrates a system in accordance with one embodiment.

In one embodiment, RFID module 540 achieves the combination functionality of EAS and RFID within the same device using the existing capability of any manufacturer's RFID device to mix two or more frequencies that may be coupled to the RFID module 540. In one embodiment, the mixing function provides the EAS functionality at low field (e.g., magnetic, electric, or electromagnetic) levels, for example when the fields are too low to produce a supply voltage above the threshold voltage in RFID module 540. Therefore, RFID module 540 provides EAS functionality at longer ranges. In one embodiment, the RFID function may be obtained in a conventional manner with an RFID reader, for example FIG. 6 is one embodiment of system 100 comprising nodes 110, 120, which is illustrated as system 600. In one embodiment, system 600 may comprise EAS system, 610 and system 630, which collectively may comprise one embodiment of node 110, for example. One embodiment of EAS system 610 may comprise one embodiment of module 112 shown as transmitter 612. One embodiment of EAS system 610 may comprise one embodiment of module 114, shown as system 630. And one embodiment of EAS system 610 may comprise one embodiment of module 116, shown as receiver 614, for example. In one embodiment, transmitter 612 is to transmit first interrogation signal 616 and may represent one embodiment of first EAS transmitter 510, for example. In one embodiment, system 630 is to transmit second mixing signal 622 and may represent one embodiment of second EAS transmitter 520, for example. In one embodiment, the fields associated with first and second signals 616, 622 overlap each other in the controlled coverage area. In one embodiment, receiver 614 to receive signal 618, which comprises the mixing products of first interrogation signal 616 and second mixing signal 622, for example, and may represent one embodiment of EAS receiver 530.

System 600 also comprises RFID module 602, for example. One embodiment of RFID module 602 comprises one embodiment of wireless communication module 122 comprising RFID/EAS functionality of RFID module 214. In one embodiment, RFID module 602 comprises antenna 604, frequency mixing circuit elements 606, and controller 608, for example. RFID module 602 receives first and second signals 616, 622, mixes the frequencies of these signals, and transmits third signal 618, which is comprised of the mixing products of first and second signals 616, 622, for example, in response to the interrogation signal (e.g., first signal 616), for example. In one embodiment, RFID module 602 may comprise a UHF EAS tag or label, for example.

In one embodiment, antenna 604 may be a dipole antenna and circuit elements 606 may include one or more non-linear mixing elements as discussed above, for example. RFID module 602 also may comprise the functionality of combined function RFID/EAS module 214 as previously discussed, for example. In one embodiment, RFID module 602 receives first and second signals 616, 622, mixes these signals, and re-radiates third signal 618. The resulting mixed frequency signal product of the first and second signal 616, 622 frequencies is the third signal 618 frequency, for example.

In one embodiment, the first signal 616 frequency is transmitted to RFID module 602 and is capacitively coupled via an induced field with the second signal 622 frequency, for example. In one embodiment, first signal 616 frequency is 915 MHz and second signal 622 frequency is 111.5 kHz, for example. Dipole antenna 604 may be tuned to first signal 616 frequency of 915 MHz. When RFID module 602 is located in both the 915 MHz and the 111.5 kHz interrogation fields, these frequencies are mixed by circuit elements 606 in RFID module 602 and the mixing products are transmitted to the EAS system 610 receiver 614 antenna for detection. In one embodiment, circuit elements 606 provide a strong non-linearity to facilitate the mixing process. Any electronic circuit with the ability to efficiently couple both interrogating fields of first and second signals 616, 622 that contain a non-linear element or elements, such as a diode, may be used to mix the signals and re-transmit the mixing products to receiver 614 for detection and alarm activation. In one embodiment, an off-the-shelf RFID module 602, for example, either meets the mixing criteria, or may be slightly adjusted to meet the criteria suitable to implement the mixing function. Slight modifications may be made to RFID module 602 to optimize coupling of both first and second signal 616, 622. Although specific frequencies and modulation techniques have been described, embodiments of RFID module 602 may be implemented using a wide range of frequencies and modulation techniques.

EAS systems generally have greater detection range than RFID systems. One reason for this difference is the threshold voltage required to turn on and power an RFID semiconductor integrated circuit. The RFID threshold voltage is provided by the transmitted drive field such as, electric or magnetic field, of first and second radiated signals 616, 622, for example. EAS systems, however, do not require a turn-on threshold and will remain operational at very low drive-field levels. Generally, a mixing type EAS system 610 does not have a turn-on threshold voltage and therefore may have larger read-range than an RFID system.

In one embodiment, EAS system 610 may be implemented without a turn-on threshold, for example. System 610 may comprise a first transmitter antenna to transmit first signal 616 and a second receiver antenna to receive a third signal 618 having a frequency which is the product of mixed first and second signal 616, 622 frequencies, for example. In one embodiment, first signal 616 frequency may be 915 MHz, for example, and second signal 618 may be a resulting mixed frequency, for example.

In one embodiment, system 630 may comprise generator 620, for example. System 600 may be implemented to transmit and receive information from RFID module 602 when it is present within the operable range (e.g., transmission and reception) of EAS system 510. System 630 may comprise generator 620 to generate second signal 622. In one embodiment, generator 620 generates second signal 622, which may be radiated from a plane 624 in a direction towards RFID module 602. In one embodiment, generator 620 is an electric field generator, for example. In one embodiment, second signal 622 may comprise a 111.5 kHz electric field. In one embodiment, second signal 622 may be modulated using frequency shift keying (FSK) modulation in a frequency range of 650-950 Hz, for example.

Figure 7:
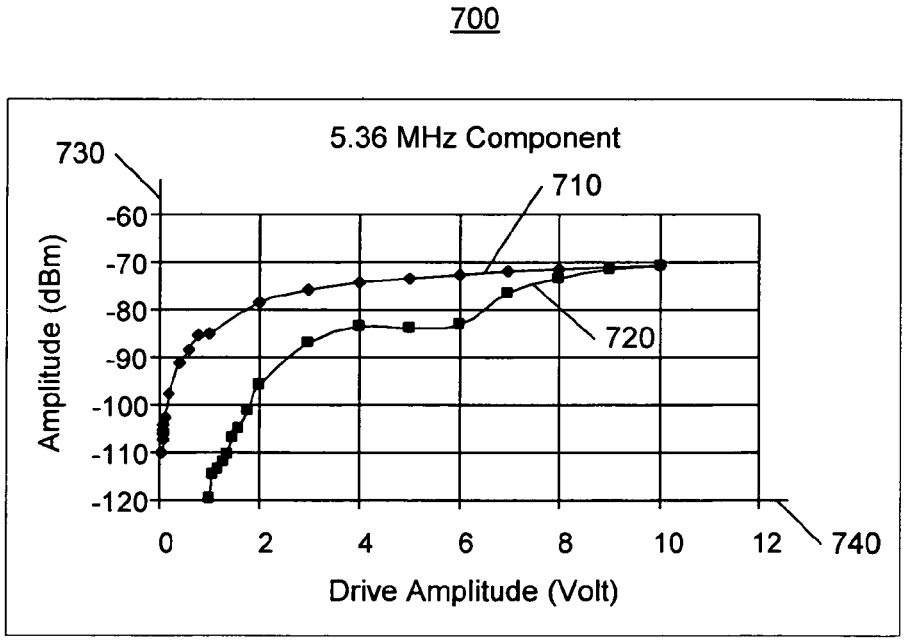
FIG. 7 graphically illustrates a difference frequency component in accordance with one embodiment.

For example, FIG. 7 graphically illustrates at 700 the difference frequency component between an RFID module (e.g., 122, 214, 300, 400, 500, 602) operating at first signal frequency of 13.56 MHz and at a second signal frequency of 8.2 MHz. Amplitude in dBm is shown on vertical axis 730 and drive amplitude in volts is shown on horizontal axis 740. FIG. 7 illustrates first signal (e.g., 130, 514, 616) operating at a frequency of 13.56 MHz at graph 710, and second signal (e.g., 140, 524, 622) operating at a mixing frequency of 8.2 MHz at graph 720. Measurements show that when an RFID module (e.g., 122, 214, 300, 400, 500, 602) operating at a first signal (e.g., 130, 514, 616) frequency of 13.56 MHz is mixed with a second signal (e.g., 140, 524, 622) at a mixing frequency of 8.2 MHz, detectible levels of mixing component at the difference frequency of 5.36 MHz, for example, is obtained. Thus, third signal (e.g., 116, 544, 618) frequency of 5.36 MHz is generated and re-radiated by RFID module (e.g., 122, 214, 300, 400, 500, 602) to EAS receiver (e.g., 116, 530, 614).

Figure 8:
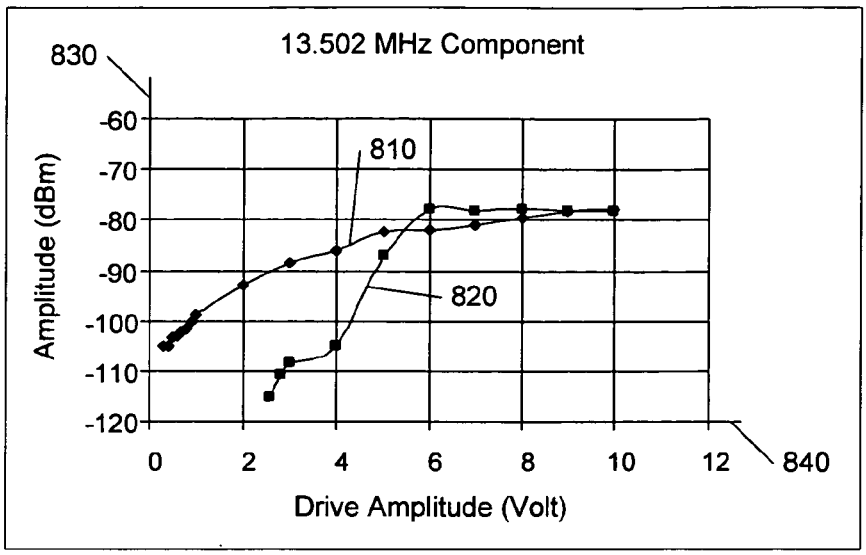
FIG. 8 graphically illustrates a difference frequency component in accordance with one embodiment.

Similar results were obtained for an RFID module (e.g., 122, 214, 300, 400, 500, 602) operating at 13.56 MHz and a second mixing frequency of 58 kHz. Here, the mixing component observed was 13.502 MHz as shown in the graph below. Accordingly, FIG. 8 graphically illustrates at 800 the difference frequency component between an RFID module (e.g., 122, 214, 300, 400, 500, 602) operating at first signal frequency of 13.56 MHz and at a second signal frequency of 58 kHz. Amplitude in dBm is shown on vertical axis 830 and drive amplitude in volts is shown on horizontal axis 840. FIG. 8 illustrates first signal (e.g., 130, 514, 616) operating at a frequency of 13.56 MHz at graph 810, and second signal (e.g., 140, 524, 622) operating at a mixing frequency of 58 kHz at graph 820. Measurements show that when an RFID module (e.g., 122, 214, 300, 400, 500, 602) operating at a first signal (e.g., 130, 514, 616) frequency of 13.56 MHz is mixed with a second signal (e.g., 140, 524, 622) at a mixing frequency of 58 kHz, detectible levels of mixing component at the difference frequency of 13.502 MHz, for example, is obtained. Thus, third signal (e.g., 116, 544, 618) frequency of 13.502 MHz is generated and re-radiated by RFID module (e.g., 122, 214, 300, 400, 500, 602) to EAS receiver (e.g., 116, 530, 614).

Figure 9:
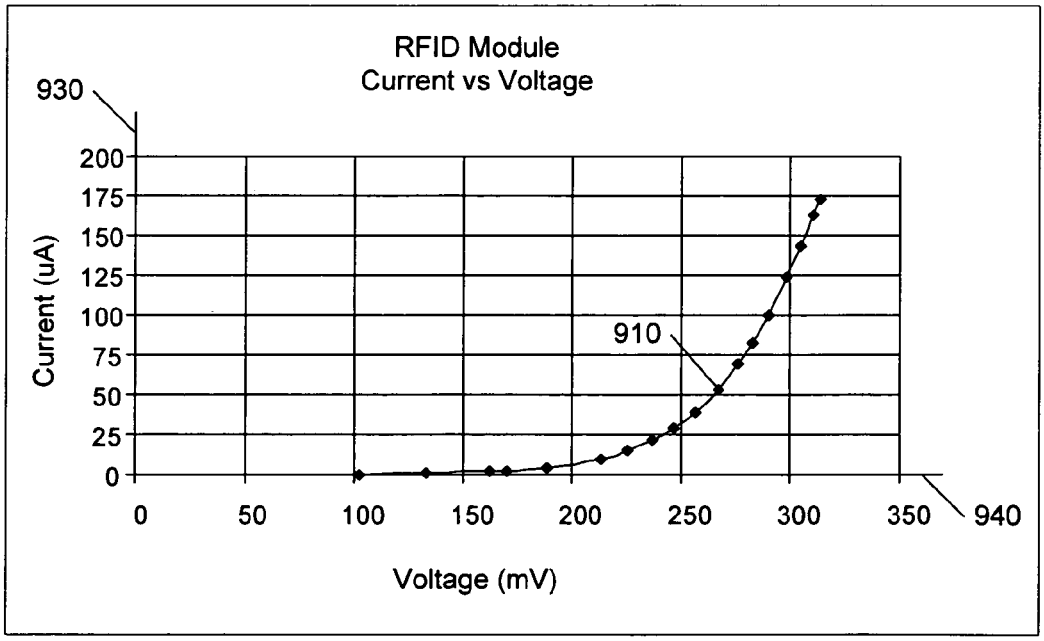
FIG. 9 graphically illustrates a plot in accordance with one embodiment.

FIG. 9 graphically illustrates a plot 900 of the DC current versus the voltage at the input terminals of an RFID module (e.g., 122, 214, 300, 400, 500, 602) designed to operate at 915 MHz. Plot 900, graphically illustrates the non-linearity of RFID module (e.g., 122, 214, 300, 400, 500, 602). In one embodiment, RFID module (e.g., 122, 214, 300, 400, 500, 602) comprises detection characteristics similar to a conventional EAS label in UHF EAS system 600 described above with reference to FIG. 6. This illustrates the compatibility of RFID module (e.g., 122, 214, 300, 400, 500, 602) with a UHF EAS system 600 without any modification to RFID module (e.g., 122, 214, 300, 400, 500, 602).

Furthermore, each of the systems, nodes, elements, and/or sub-elements previously described may comprise or be implemented as, one or more modules, components, registers, processors, software subroutines, modules, or any combination thereof, as desired for a given set of design or performance constraints. Although the figures may show a limited number of elements by way of example, those skilled in the art will appreciate that additional or fewer elements may be used as desired for a given implementation. The embodiments are not limited in this context.

Embodiments of wireless communication module 122 (e.g., RFID module 214, 300, 400, 500, 602) may be fabricated in a variety of techniques. In one embodiment, any element of wireless communication module 122, including energy coupler 124 and/or controller 126, may be printed on a substrate using organic/inorganic semiconducting inks. Organic/inorganic semiconducting inks are currently used to form organic light emitting diodes (OLEDs) are extremely thin semi-conducting organic polymers suitable for a wide variety of applications, including light sources and displays. The technology comprises placing a series of organic thin films between two conductors. When electric current is applied, they emit light. These and other polymer based electronic components may be used in applications such as solar cells, organic thin film transistors (TFTs), RFID tags, and other high-tech products. These polymer based techniques may reduce costs associated with handling and fabricating of any of these elements.

Wireless communication module 122 (e.g., RFID module 214, 300, 400, 500, 602) may be fabricated on a flexible substrate with embodiments or portions of energy coupler 124 (e.g., antenna 202, antenna coil 312, resonating capacitor 314, dipole antenna 412, matching network 420, dipole antenna 604) formed on the flexible substrate of a particular metallic pattern. Embodiments or portions of energy coupler 124 may be fabricated by various methods, such as, die-cutting, chemical etching, physical/chemical deposition processing, print processing, and printing using organic/inorganic semiconducting inks, or any combination thereof. Embodiments or portions of energy coupler 124 may comprise loops of wire or may be metal etched or plated and soldered or wire bonded to controller 126. In one embodiment, energy coupler 124 may comprise, for example, a lead-frame antenna. Controller 126 (e.g., IC 210, IC 302) may comprise a silicon die positioned on the substrate and attached to energy coupler 124, for example, or attached to energy coupler terminals A, B formed on the substrate, for example. Energy coupler 124 may be physically, electrically, inductively, or capacitively attached to controller 126, for example. Any of the wireless communication module 122 components may be printed on the substrate with organic/inorganic semiconducting inks, for example.

In one embodiment, wireless communication module 122 (e.g., RFID module 214, 300, 400, 500, 602) may be manufactured by mounting energy coupler 124 elements and other individual elements to controller 126. This may be done by using either short wire bond connections or soldered connections such as ball grid array (bumps) between controller 126 and other circuit elements: RF circuit 204 (e.g., capacitors, diodes, transistors, etc.), antenna 202, antenna coil 312, resonating capacitor 314, dipole antenna 412, matching network 420, dipole antenna 604, logic 206, memory 208, power controller 324, demodulator and data recovery 326, state machine 328, modulator 330, and/or memory 332) and so forth. In one embodiment, controller 126 may be supported by a custom lead-frame which serves as its support and antenna. Controller 126 may be either wire-bonded to the lead-frame or bumped and flipped onto it prior to over molding. The entire wireless communication module 122 may comprise an assembly of elements. These elements may be embedded in and form an integral part of wireless communication module 122 to provide a means of physical enclosure. In one embodiment, wireless communication module 122 including energy coupler 124 and controller 126 may be injection molded into plastic package forming a single tag to be attached to an article.

Operations of the above systems, nodes, apparatus, elements, and/or subsystems may be further described with reference to the above figures and accompanying examples. Some of the figures may include programming logic. Although such figures presented herein may include a particular programming logic, it can be appreciated that the programming logic merely provides an example of how the general functionality as described herein can be implemented. Further, the given programming logic does not necessarily have to be executed in the order presented unless otherwise indicated. In addition, the given programming logic may be implemented by a hardware element, a software element executed by a processor, or any combination thereof. The embodiments are not limited in this context.

Figure 10:
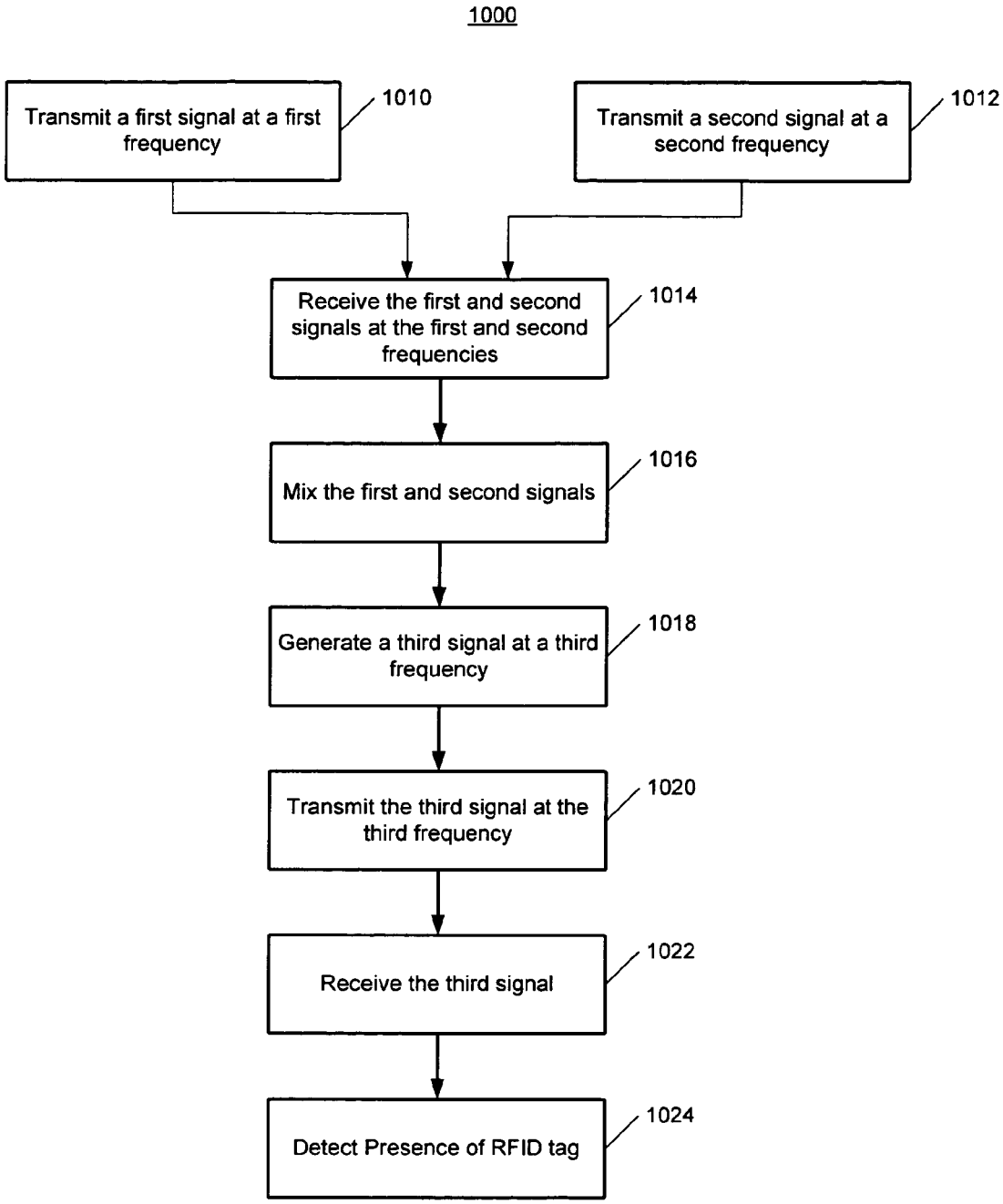
FIG. 10 illustrates a programming logic in accordance with one embodiment.

FIG. 10 illustrates a logic flow diagram representative of a method in accordance with one embodiment. In one embodiment, FIG. 10 may illustrate a programming logic 1000. Programming logic 1000 may be representative of the operations executed by nodes 110, 120, systems 100, 500, and 600, and structures 200, 300, 400, described herein. As shown in diagram 1000, the operation of the above described nodes 110, 120, systems 100, 500, and 600, and structures 200, 300, 400, and associated programming logic may be better understood by way of example.

In one embodiment, at block 1010, an EAS detection system transmits a first signal at a first frequency and at block 1012 transmits a second signal at a second frequency. Accordingly, at block 1014, an RFID module receives the first and second signals at the first and second frequencies. In one embodiment, the first signal is at a frequency of about 13.56 MHz. In one embodiment, the first signal at a frequency of about 915 MHz. In one embodiment, the second signal is at a frequency of about 8.2 MHz. In one embodiment, the second signal is at a frequency of about 58 kHz. In one embodiment, the second signal is at a frequency of about 111.5 kHz. At block 1016, the first and second signals are mixed. At block 1018, a third signal is generated at a third frequency. At block 1020, the third signal is transmitted. In one embodiment, at block 1022, the EAS detection system receives the third signal at the third frequency, and at block 1024 detects the presence of the RFID module acting as an EAS tag. In one embodiment, the third signal is at a frequency of about 5.36 MHz. In one embodiment, the third signal is at a frequency of about 13.502 MHz. In one embodiment, the second signal is FSK modulated at a frequency ranging from 650-950 Hz.

Numerous specific details have been set forth herein to provide a thorough understanding of the embodiments. It will be understood by those skilled in the art, however, that the embodiments may be practiced without these specific details. In other instances, well-known operations, components and modules have not been described in detail so as not to obscure the embodiments. It can be appreciated that the specific structural and functional details disclosed herein may be representative and do not necessarily limit the scope of the embodiments.

It is also worthy to note that any reference to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Some embodiments may be implemented using an architecture that may vary in accordance with any number of factors, such as desired computational rate, power levels, heat tolerances, processing cycle budget, input data rates, output data rates, memory resources, data bus speeds and other performance constraints. For example, an embodiment may be implemented using software executed by a general-purpose or special-purpose processor. In another example, an embodiment may be implemented as dedicated hardware, such as a module, an application specific integrated module (ASIC), Programmable Logic Device (PLD) or digital signal processor (DSP), and so forth. In yet another example, an embodiment may be implemented by any combination of programmed general-purpose computer components and custom hardware components. The embodiments are not limited in this context.

Some embodiments may be described using the expression "coupled" and "connected" along with their derivatives. It should be understood that these terms are not intended as synonyms for each other. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

Some embodiments may be implemented, for example, using a machine-readable medium or article which may store an instruction or a set of instructions that, if executed by a machine, may cause the machine to perform a method and/or operations in accordance with the embodiments. Such a machine may include, for example, any suitable processing platform, computing platform, computing device, processing device, computing system, processing system, computer, processor, or the like, and may be implemented using any suitable combination of hardware and/or software. The machine-readable medium or article may include, for example, any suitable type of memory unit, memory device, memory article, memory medium, storage device, storage article, storage medium and/or storage unit, for example, memory, removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD), a tape, a cassette, or the like. The instructions may include any suitable type of code, such as source code, compiled code, interpreted code, executable code, static code, dynamic code, and the like. The instructions may be implemented using any suitable high-level, low-level, object-oriented, visual, compiled and/or interpreted programming language, such as C, C++, Java, BASIC, Perl, Matlab, Pascal, Visual BASIC, assembly language, machine code, and so forth. The embodiments are not limited in this context.

Unless specifically stated otherwise, it may be appreciated that terms such as "processing," "computing," "calculating," "determining," or the like, refer to the action and/or processes of a computer or computing system, or similar electronic computing device, that manipulates and/or transforms data represented as physical quantities (e.g., electronic) within the computing system's registers and/or memories into other data similarly represented as physical quantities within the computing system's memories, registers or other such information storage, transmission or display devices. The embodiments are not limited in this context.

While certain features of the embodiments have been illustrated as described herein, many modifications, substitutions, changes and equivalents will now occur to those skilled in the art. It is therefore to be understood that the appended claims are intended to cover all such modifications and changes as fall within the true spirit of the embodiments.

What is claimed is:

1. A system, comprising:

an RFID module comprising memory to store RFID information and an energy coupler, said energy coupler to receive transmitted energy comprising a first signal at a first frequency and a second signal at a second frequency, and a mixing element to mix said first and second signals, to generate a third signal at a third frequency, and said energy coupler to transmit said third signal to an EAS detection system, wherein said RFID module is configured to operate as an EAS tag, to receive and mix said first and second signals, and to generate and transmit said third signal to said EAS detection system irrespective of power supply voltage to said RFID module.

2. The system of claim 1, further comprising:

a first transmitter to transmit said energy comprising said first signal at said first frequency in a controlled area; and a second transmitter to transmit said energy comprising said second signal at said second frequency in said coverage area, wherein said first and second signals form overlapping fields in said controlled area.

3. The system of claim 1, further comprising a receiver to receive said third signal and to detect a presence of said RFID module in said controlled area.

4. The system of claim 1, wherein said energy coupler comprises an inductor and a capacitor.

5. The system of claim 1, wherein said first signal is an electromagnetic signal and said second signal is a magnetic field.

6. The system of claim 1, wherein said first frequency is greater than said second frequency.

7. The system of claim 1, wherein said first frequency is selected from the group consisting of about 13.56 MHz and about 915 MHz.

8. The system of claim 1, wherein said second frequency is selected from the group consisting of about 8.2 MHz, about 111.5 kHz, and about 58 kHz.

9. The system of claim 1, wherein said third frequency is selected from the group consisting of about 5.36 MHz and 13.502 MHz.

10. The system of claim 1, wherein said mixer comprises a non-linear element.

11. The system of claim 10, wherein said non-linear element is selected from the group consisting of modulation impedance, tuning capacitor, varactor, metal oxide semiconductor (MOS) capacitor, complementary MOS capacitor, varactor diode capacitor, AC/DC converter, rectifier, diode, bipolar junction transistors, field effect transistor, magnetic element, and non-linear resonator.

12. The system of claim 1, wherein said energy coupler comprises a dipole antenna and a matching network.

13. The system of claim 1, wherein said first signal is an electromagnetic signal and said second signal is a magnetic field.

14. The system of claim 1, wherein said second frequency is FSK modulated with a signal at a frequency ranging from 650-950 Hz.

15. A method, comprising:

receiving a first and second signal at a first and second frequency at an RFID module, comprising memory to store RFID information and;

mixing said first and second signals at said RFID module;

generating a third signal at a third frequency; and transmitting said third signal to an EAS detection system;

wherein said RFID module is configured to operate as an EAS tag, to receive and mix said first and second signals, and to generate and transmit said third signal to said EAS detection system irrespective of power supply voltage to said RFID module.

16. The method of claim 15, further comprising:

transmitting said first signal at said first frequency; and transmitting said second signal at said second frequency.

17. The method of claim 16, further comprising:

receiving said third signal at said third frequency; and detecting a presence of said RFID module.

18. The method of claim 15, wherein receiving said first signal at said first frequency comprises receiving said first signal at a frequency selected from the group consisting of about 13.56 MHz and about 915 MHz.

19. The method of claim 15, wherein receiving said second signal at said second frequency comprises receiving said second signal at a frequency selected from the group consisting of about 8.2 MHz, about 111.5 kHz, and about 58 kHz.

20. The method of claim 15, wherein receiving said third signal at said third frequency comprises receiving said third signal at a frequency selected from the group consisting of about 5.36 MHz and about 13.502 MHz.

21. The method of claim 15, further comprising FSK modulating said second frequency.

* * * * *